US005979040A

United States Patent [19]

Houki

[11] Patent Number: 5,979,040

[45] Date of Patent: Nov. 9, 1999

[54] METHOD OF MAKING AUXILIARY ELECTRODE LAYER FOR COMMON ELECTRODE PATTERN IN THERMAL PRINTHEAD

[75] Inventor: Hideaki Houki, Kyoto, Japan

[73] Assignee: Rohm Co., Ltd., Kyoto, Japan

[21] Appl. No.: 08/776,802

[22] PCT Filed: Jun. 13, 1996

[86] PCT No.: PCT/JP96/01632

§ 371 Date: Feb. 10, 1997

§ 102(e) Date: Feb. 10, 1997

[87] PCT Pub. No.: WO96/41722

PCT Pub. Date: Dec. 27, 1996

[30] Foreign Application Priority Data

Jun. 13, 1995 [JP] Japan ..... 7-182018

[51] Int. Cl.[6] ..... H01R 43/16; H05B 3/00

[52] U.S. Cl. ..... 29/611; 29/874; 347/59

[58] Field of Search ..... 29/611, 874; 347/58, 347/59, 62

[56] References Cited

U.S. PATENT DOCUMENTS 4,630,073 12/1986 Hashimoto .
5,317,341 5/1994 Tatsumi ..... 29/611

FOREIGN PATENT DOCUMENTS 0 711 669 5/1996 European Pat. Off. .
61-187292 8/1986 Japan .
62-25067 2/1987 Japan .
2-179765 7/1990 Japan .
5-330107 12/1993 Japan .

OTHER PUBLICATIONS

Patent Abstracts of Japan—vol. 012, No. 087 (M–678), Mar. 19, 1988 & JP 62 227764 A (Seiko Epson Corp), Oct. 6, 1987, *abstract* rel. to claims 1–4,Narita Toshio; Thermal Printing Head; Jun. 10, 1987.

Patent Abstracts of Japan—vol. 014, No. 450 (M–1030), Sep. 27, 1990 & JP 02 179765 A (NEC Corp), Jul. 12, 1990, *abstract* rel. to claim 1, Tachiki Shigemi; Thermal Head Substrate; Dec. 7, 1990.

*Primary Examiner*—P. W. Echols
*Attorney, Agent, or Firm*—Michael D. Bednarek; Crowell & Moring LLP

[57] ABSTRACT

The present invention provides a method of making an auxiliary electrode layer for a common electrode pattern in a thermal printhead. The method of the present invention includes the steps of: preparing a master substrate (1') which has an obverse surface provided with a common electrode pattern (4) and corresponds to a plurality of head substrates; forming at least one slit (9) in the master substrate (1') where the slit extends along the common electrode pattern (4); and forming an auxiliary electrode layer (6) on a reverse surface of the master substrate (1') so that the auxiliary electrode layer (6) extends via the slit (9) for electrical connection to the common electrode pattern (4). The slit has a width of no less than 0.5 mm for example, particularly no less than 0.8 mm for controlling to provide a proper turnover (R) of the auxiliary electrode layer (6).

4 Claims, 7 Drawing Sheets

METHOD OF MAKING AUXILIARY ELECTRODE LAYER FOR COMMON ELECTRODE PATTERN IN THERMAL PRINTHEAD

TECHNICAL FIELD

The present invention relates to a method of making an auxiliary electrode layer for a common electrode pattern in a thermal printhead.

BACKGROUND ART

Thermal printheads have been widely used for a printer of an office automation apparatus such as a facsimile machine, a printer of a ticket vending machine and a label printer. As is commonly known, a thermal printhead selectively provides heat to a printing medium such as thermosensitive paper or thermal-transfer ink ribbon to form needed image information.

Thermal printheads are divided mainly into thin film-type thermal printheads and thick film-type thermal printheads, depending upon methods of forming their heating resistors (heating dots) and electrode conductor layers for example. In a thin film-type thermal printhead, a heating resistor and an electrode conductor layer are made in the form of a thin film on a substrate or a glass glaze layer by sputtering for example. On the other hand, in a thick film-type thermal printhead, at least the heating resistor is made in the form of a thick film through such steps as screen printing and sintering.

In general, for thermal printheads, a series of linear heating dots are formed preferably adjacent to a longitudinal edge of the head substrate. This is because the arrangement of disposing the series of heating dots adjacent to a longitudinal edge of the head substrate advantageously makes it possible to avoid interference with the printing medium as well as to increase degrees of positioning freedom and improve printing quality by holding the head substrate relative to the platen at a certain angle.

However, when the series of heating dots are adjacent to a longitudinal edge of the head substrate, space for formation of the common electrode pattern is correspondingly reduced, thereby failing to provide a sufficient current capacity (current passage) necessary for heat generation. As a result, the resistance of the common electrode pattern will cause a problem of irregular heat generation at the heating dots due to a voltage drop along the series of heating dots, which results in deterioration of printing quality. Particularly for color printing, which has been coming into wider use recently, it is highly required to ensure a large current capacity since all of the heating dots are frequently heated simultaneously to perform so-called "solid printing."

To meet such a requirement, International Publication WO 95/32867 discloses a thermal printhead with the arrangement shown in FIGS. 5 and 6 of the attached drawings of the present application. (Note that the above international publication was published on Dec. 7, 1995, which is later than the priority date of the present application, Jun. 13, 1995, so that the international publication is not to be regarded as prior art against the present application.) The above-mentioned thermal printhead will be described below.

The thermal printhead illustrated in FIGS. 5 and 6 includes a head substrate 11 of an insulating material such as alumina-ceramic for example. The head substrate 11, which is rectangular in cross section, includes an obverse surface 11*a*, a reverse surface 11*b* opposite to the obverse surface 11*a*, a first longitudinal edge surface 11*c* and a second longitudinal edge surface 11*d* opposite to the first longitudinal edge surface 11*c*. The obverse surface 11*a* of the head substrate 11 is formed with a glass glaze layer 12 as a heat reservoir. The glass glaze layer 12 includes a convex portion 12*a*, adjacent to the first longitudinal edge surface 11*c* of the head substrate 11, which has a curved cross section.

The surface of the glaze layer 12 is formed with a thin film of a resistor layer 13. The resistor layer 13 is divided by slits S (see FIG. 6) at a predetermined pitch to extend transversely of the head substrate 11 (that is, perpendicularly of the longitudinal edge surfaces 11*c*, 11*d* of the head substrate 11).

The surface of the resistor layer 13 is formed with a common electrode pattern 14 adjacent to the first longitudinal edge surface 11*c* of the head substrate 11, and individual electrodes 15 which are spaced from the common electrode pattern 14 and extend from the convex portion 12*a* of the glaze layer 12 toward the second longitudinal edge surface 11*d* of the head substrate 11.

The slits S extending to the common electrode pattern 14 electrically insulate the individual electrodes 15 from each other.

As described above, the individual electrodes 15 are spaced from the common electrode pattern 14. Thus, the resistor layer 13 is exposed between the common electrode pattern 14 and the individual electrodes 15, and the exposed portions function as heating dots (heating regions) 13*a* linearly extending along the first longitudinal edge surface 11*c* of the head substrate 11.

The heating regions (heating dots) 13*a* of the resistor layer 13, the common electrode pattern 14 and the individual electrodes 15 are covered with a protecting layer 20. Due to the protecting layer 20, the common electrode pattern 14 and the individual electrodes 15 are prevented from getting oxidized through contact with the air and worn out through contact with a printing medium (not shown).

The common electrode pattern 14 is electrically connected, at an end closer to the first longitudinal edge surface 11*c* of the head substrate 11, to an auxiliary electrode layer 16 made of a metal such as aluminum for example. Thus, every portion of the common electrode pattern 14 is electrically connected to each other via the auxiliary electrode layer 16, thereby being kept at a same electrical potential. In other words, the auxiliary electrode layer 16 functions as a member commonly connecting all portions of the common electrode pattern 14.

The auxiliary electrode layer 16 covers the first longitudinal edge surface 11*c* of the head substrate 11, the reverse surface 11*b* and the second longitudinal edge surface 11*d*. Thus, the auxiliary electrode layer 16 has a large area to allow increased electrical passage so that the voltage drop which might otherwise be caused longitudinally of the thermal printhead is substantially eliminated. As a result, a large amount of current is provided even for an instance where all heating dots 13*a* are simultaneously heated (that is, even for solid printing), thereby preventing deterioration of printing quality.

The thermal printhead with the above arrangement may be formed by a method illustrated by FIGS. 7*a*–7*j* for example.

First, as shown in FIG. 7*a*, an alumina-ceramic master substrate 11' dimensionally corresponding to a plurality of head substrates is prepared. The master substrate 11' will be divided later along longitudinal division lines DL1 and transverse division lines DL2 to provide the plurality of head substrates.

Then, as shown in FIG. 7*b*, a master glaze layer 121 is formed by sintering a glass paste which is applied over the master substrate 11'.

Then, as shown in FIG. 7*c*, a groove 17 extending into the thickness of the master substrate 11' is formed by using a dicing cutter (not shown) which cuts through the master glaze layer 12' along a predetermined longitudinal division line DL1. Thus, the master glaze layer 12' is divided into separate glaze layers 12.

Then, as shown in FIG. 7*d*, the glaze layer 12 is formed with a convex portion 12*a* adjacent to the groove 17 by heating the master substrate 11' at a temperature of about 850° C. for about 20 minutes. The formation of the convex portion 12*a* is realized under the influence of the surface tension of the glass material which is in a liquidized state by the heating.

Then, as shown in FIG. 7*e*, a resistor layer 13 including tantalum nitride as the main component is made in the form of a thin film over the glaze layer 12 by reactive sputtering.

Then, as shown in FIG. 7*f*, a conductive layer 18 of e.g. aluminum is formed on the resistor layer 13 by sputtering.

Then, as shown in FIG. 7*g*, after forming the slits S (see FIG. 6) by etching the resistor layer 13 and the conductive layer 18, only the conductor layer 18 is partially removed by etching for exposure of portions of the resistor layer 13 to form heating dots 13*a*. Thus, the conductor layer 18 is divided into the common electrode pattern 14 and the individual electrodes 15.

Then, as shown in FIG. 7*h*, the master substrate 11' is divided by a dicing cutter (not shown) along the respective division lines DL1, DL2 to provide separate head substrates 11.

Then, as shown in FIG. 7*i*, while each head substrate 11 is being moved in the direction of arrow X, conductive metal is sputtered from below to be fixed on the first longitudinal edge surface 11*c*, the reverse surface 11*b* and the second longitudinal edge surface 11*d* for forming a proper thickness of the auxiliary electrode layer 16 made of aluminum for example.

Finally, as shown in FIG. 7*j*, a protecting layer 20 is formed to cover the common electrode pattern 14, the individual electrodes 15 and the heating dots 13*a* or the exposed regions of the resistor layer 13.

In the method described above, the formation of the auxiliary electrode layer 16 is performed after the division of the master substrate 11' into the separate head substrates 11 (see FIGS. 7*h* and 7*i*). However, it has been found that the following problems will occur by the method of making the auxiliary electrode layer 16 described above.

First, since the auxiliary electrode layers 16 are formed after the master substrate 11' is divided into the plurality of separate head substrates 11, specially adjusted magazines and tools are needed to deal with the plurality of head substrates 11 individually, which results in a larger equipment cost. Further, the process of making an auxiliary electrode layer 16 individually for each of a plurality of head substrates 11 will make the production rate low. Such a factor, together with the increased equipment cost, will increase the production cost.

Secondly, when the auxiliary electrode layer 16 is formed for each separate head substrate 11, the conductive metal to be sputtered can easily reach the obverse surface of the head substrate 11, going beyond the common electrode pattern, and may further extend to the heating dots 13*a* or the exposed portions of the resistor layer 13. As a result, the auxiliary electrode layer 16 partially or wholly covers the heating dots 13*a* to prevent the heat generation at the heating dots 13*a*.

Thirdly, when the auxiliary electrode layers 16 are formed after dividing the master substrate 11' into the plurality of separate head substrates 11, apparatus for carrying and supporting the separate head substrates 11 will come into direct contact with the head substrates 11, thereby possibly causing a secondary damage to the obtained thermal printheads. On the other hand, when the master substrate 11' is not divided, the carrying and supporting of the master substrate 11' can be performed with the use of the marginal portions thereof. Thus, there are much less possibilities of causing a damage to the head substrates 11 which will be separated afterward.

DISCLOSURE OF THE INVENTION

Therefore, the object of the present invention is to provide a method by which an auxiliary electrode layer for a common electrode pattern is formed effectively and at a low cost for respective thermal printheads, while providing an easier control of the condition of electrical connection between the common electrode pattern and the auxiliary electrode layer.

To attain the above object, the present invention provides a method of making an auxiliary electrode layer for a common electrode pattern in a thermal printhead. The method includes the steps of:

preparing a master substrate which has an obverse surface provided with a common electrode pattern and corresponds to a plurality of head substrates;

forming at least one slit in the master substrate, the slit extending along the common electrode pattern; and forming an auxiliary electrode layer on a reverse surface of the master substrate so that the auxiliary electrode layer extends via the slit into electrical connection to the common electrode pattern.

The slit may preferably have a width of no less than 0.5 mm or particularly no less than 0.8 mm for providing good electrical connection between the auxiliary electrode layer and the common electrode pattern.

According to a preferred embodiment of the present invention, the master substrate may have at least one groove extending along the common electrode pattern and the common electrode pattern extends into the groove. A step portion is provided by forming the slit in the groove so that the slit is smaller in width than the groove. The auxiliary electrode layer is arranged to extend onto the step portion into electrical connection to the common electrode pattern.

Other objects, features and advantages of the present invention will be clearer from the detailed explanation of the embodiment described below with reference to the accompanying drawings.

BEST MODE FOR CARRYING OUT THE INVENTION

A preferred embodiment of the present invention will be described below with reference to the accompanying drawings.

Figure 1:
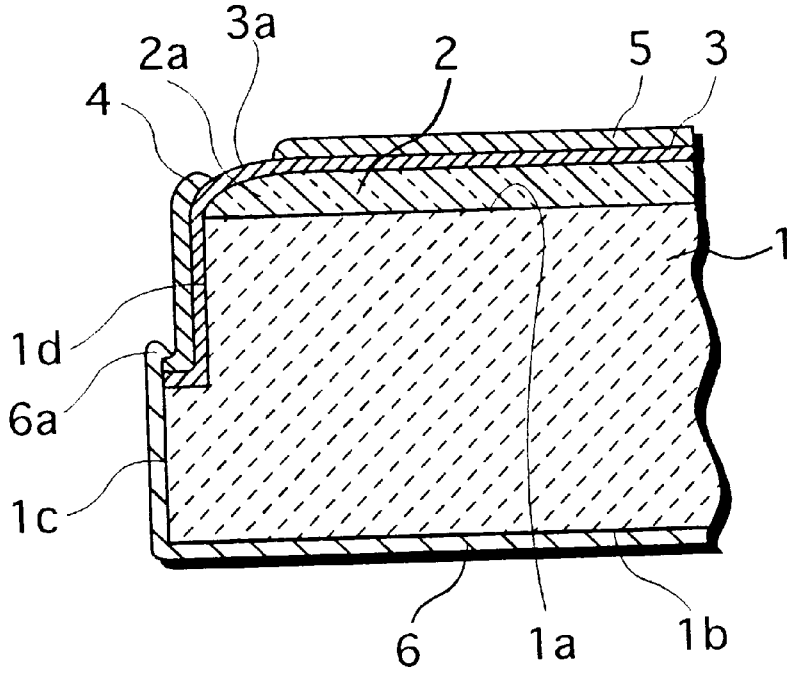
FIG. 1 is a partial sectional view showing principal parts of a thermal printhead according to a preferred embodiment of the present invention.
Figure 2:
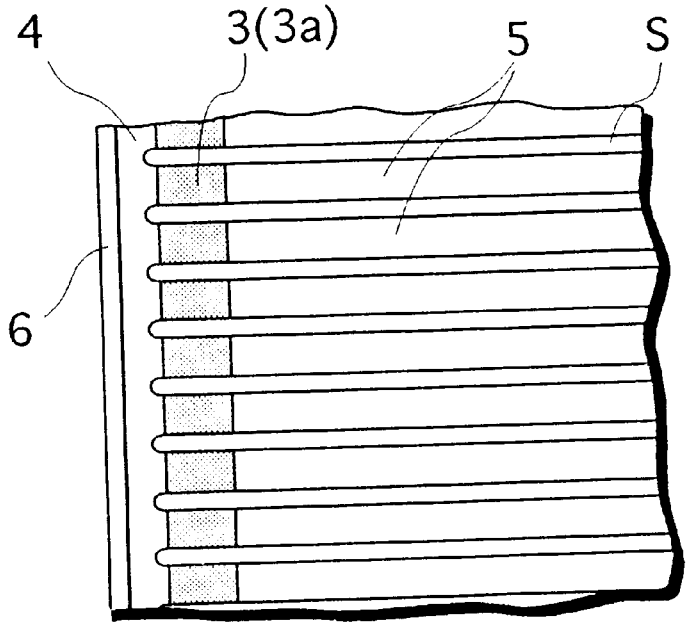
FIG. 2 is a partial plan view of the same thermal printhead.

FIGS. 1 and 2 show an example of thermal printhead made by the method according to the present invention. The thermal printhead includes an elongate head substrate 1 which is made of an insulating material such as alumina-ceramic for example and has a thickness of about 0.6–0.7 mm for example. The head substrate 1 has a generally rectangular cross section and includes an obverse surface 1*a*, a reverse surface 1*b* opposite to the surface 1*a*, a first longitudinal edge surface 1*c* and a second longitudinal edge surface (not shown) opposite to the first longitudinal edge surface 1*c*.

The obverse surface la of the head substrate 1 is formed with a glass glaze layer 2 as a heat reservoir with a thickness of about 100 $\mu$m. The glaze layer 2 includes a curved edge portion 2*a* adjacent to the first longitudinal edge surface 1*c* of the head substrate 1.

The surface of the glaze layer 2 is formed with a thin film of resistor layer 3. The resistor layer 3 is divided into individual strips which are mutually spaced by slits S (see FIG. 2) at a predetermined pitch and extend transversely of the head substrate 1 (that is, perpendicularly to the first longitudinal edge surface 1*c* of the head substrate 1).

The surface of the resistor layer 3 is formed with a common electrode pattern 4 adjacent to the first longitudinal edge surface 1*c* of the head substrate 1 and also with individual electrodes 5 which are spaced from the common electrode pattern 4 and extend from the curved edge portion 2*a* of the glaze layer 2 toward the second longitudinal edge surface (not shown) of the head substrate 1. The slits S, which extend into the common electrode pattern 4, electrically insulate the individual electrodes 5 from each other.

As described above, the individual electrodes 5 are spaced from the common electrode pattern 4. Thus, the resistor layer 3 is exposed between the common electrode pattern 4 and the individual electrodes 5 so that these exposed portions provide heating dots (heating regions) 3*a* arranged in a line along the first longitudinal edge surface 1*c* of the head substrate 1.

In the illustrated embodiment, the first longitudinal edge surface 1*c* of the head substrate 1 is formed with a step portion 1*d* onto which the resistor layer 3 and the common electrode pattern 4 extend. The portion of the common electrode pattern 4 extending onto the step portion 1*d* from the obverse surface is electrically connected to an auxiliary electrode 6 extending from the reverse surface onto the step portion 1*d*. The auxiliary electrode 6 entirely covers the reverse surface 1*b* of the head substrate 1, and this provides a largely covered area. As a result, current passage is enlarged enough to substantially prevent a voltage drop longitudinally of the head substrate 1.

Though not illustrated, the heating regions (heating dots) 3*a* of the resistor layer 3, the common electrode pattern 4 and the individual electrodes 5 may be covered with a protecting layer made of $SiO_2$ and/or $Ta_2O_5$. Such a protecting layer serves to prevent the heating regions 3*a* of the resistor layer 3, the common electrode pattern 4 and the individual electrodes 5 from being oxidized by the air or being worn out by contacting with a printing medium (not shown).

Though not illustrated either, the auxiliary electrode 6 may be formed to cover not only the first longitudinal edge surface 1*c* but also the entirety of the second longitudinal edge surface (not shown) opposite to the first longitudinal edge surface. In this way, much enlarged current passage is obtained.

The thermal printhead with the above-described arrangement may be advantageously made by the following method.

Figure 3A:
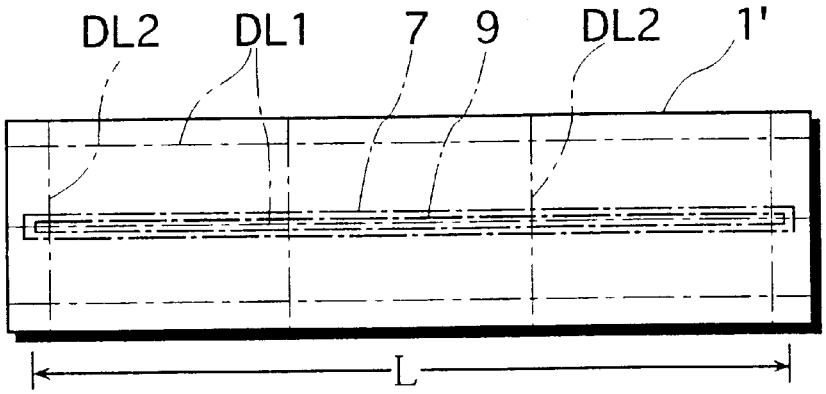
FIGS. 3*a*–3*h* illustrate subsequent steps for making the thermal printhead shown in FIGS. 1 and 2.

First, as shown in FIG. 3*a*, an alumina-ceramic master substrate 1' is prepared which is large enough to provide a plurality of head substrates after separation along longitudinal division lines DL1 and transverse division lines DL2. In the illustrated embodiment, the master substrate 1' has dimensions corresponding to two rows of three head substrates disposed longitudinally.

Figure 3B:
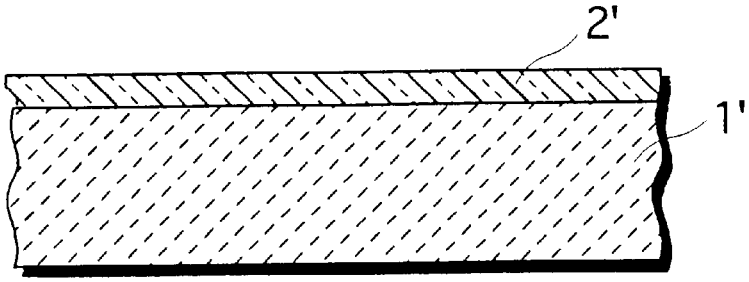

Then, as shown in FIG. 3*b*, the obverse surface of the master substrate 1' is provided with a master glaze layer 2' which is formed by sintering glass paste applied to the surface.

Figure 3C:
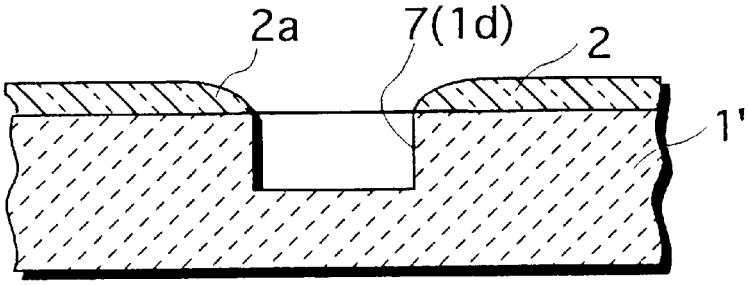

Then, as shown in FIG. 3*c*, a groove 7 extending through a master glaze layer 2' into the master substrate 1' is formed with the use of a dicing cutter (not shown) along a longitudinal center division line DL1. As a result, the master glaze layer 2' is divided into separate glaze layers 2. The groove 7 is utilized in a latter process for making a step portion 1*d*.

Then, as shown in FIG. 3*c* again, a curved edge portion 2*a* is formed adjacent to the groove 7 of the glaze layer 2 by heating the master substrate 1' at a temperature of about 850° C. for about 20 minutes. The formation of such a curved edge portion 2*a* is due to the surface tension of the glass material, which is in a liquidized state by the heating.

Figure 3D:
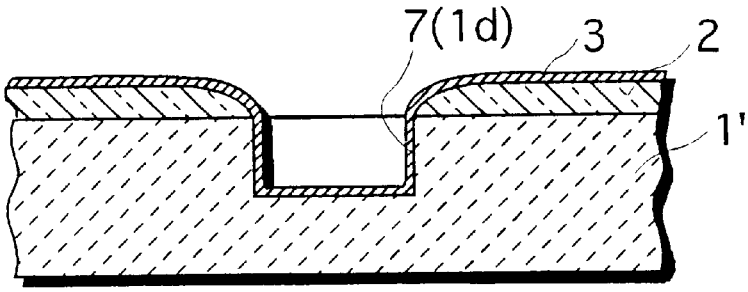

Then, as shown in FIG. 3*d*, a thin film-like resistor layer 3 is formed with a thickness of e.g. about 0.1 $\mu$m by sputtering $TaSiO_2$ over the glaze layer 2 and the master substrate 1'. As a result, the resistor layer 3 is formed to extend into the groove 7 of the master substrate 1'. The resistor layer 3 may be formed by reactive sputtering with the use of a material having tantalum nitride as the main component.

Figure 3E:
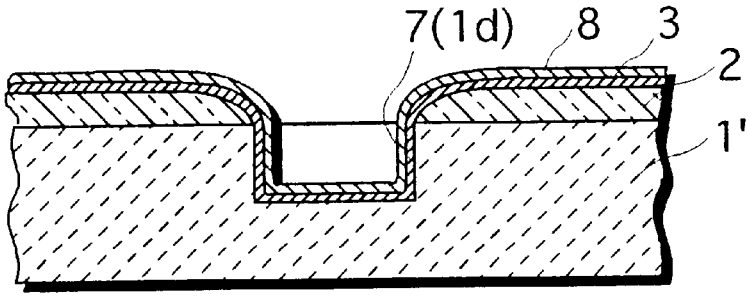

Then, as shown in FIG. 3*e*, a conductor layer 8 is formed over the resistor layer 3 by sputtering. The conductor layer 8 also extends into the groove 7 of the master substrate 1'. Typically, the conductor layer 8 is made of aluminum (Al), but it may be made of copper (Cu) or gold (Au).

Figure 3F:
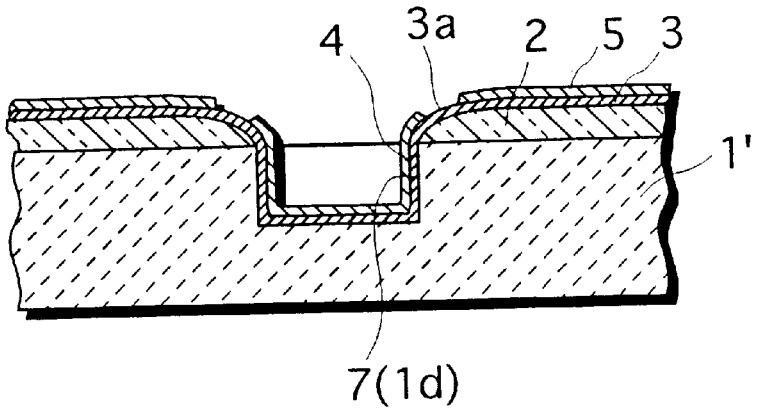

Then, as shown in FIG. 3*f*, upon formation of slits S (see FIG. 2) by etching the resistor layer 3 and the conductor layer 8, the conductor layer 8 is partially removed by etching for exposure of portions of the resistor layer 3 to provide heating dots 3*a*. As a result, the conductor layer 8 is divided into the common electrode pattern 4 and the individual electrodes 5.

Figure 3G:
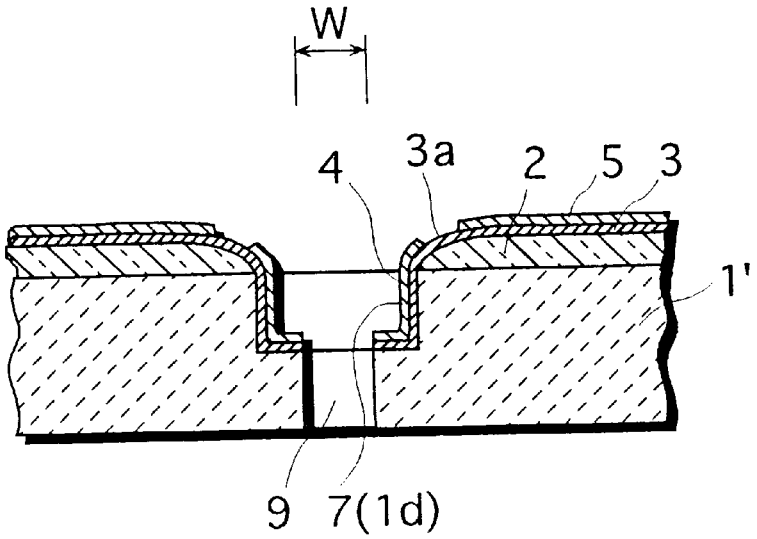

Then, as shown in FIG. 3*g*, a slit 9 is formed along the groove 7. The width W and the length L of the slit 9 (see FIG. 3*g* and FIG. 3*a*) are smaller than those of the groove 7. Thus, the groove 7 and the slit 9 provides a step portion 1*d*. At this stage, however, since the master substrate 1' is not divided into unit head substrates 1 (see FIG. 1) yet, subsequent steps can be effectively performed to the master substrate it (that is, a plurality of unit head substrates 1). The slit 9 may be formed by a dicing, laser or water-jet method for example.

The cutting manner shown in FIG. 3*g*, in which the width W of the slit 9 is smaller than that of the groove 7, is referred to as step cut. On the other hand, a cutting manner in which the slit 9 and the groove 7 are arranged to have the same width is referred to as full cut. In the present invention, it may be possible to provide a full cut instead of a step cut.

Figure 3H:
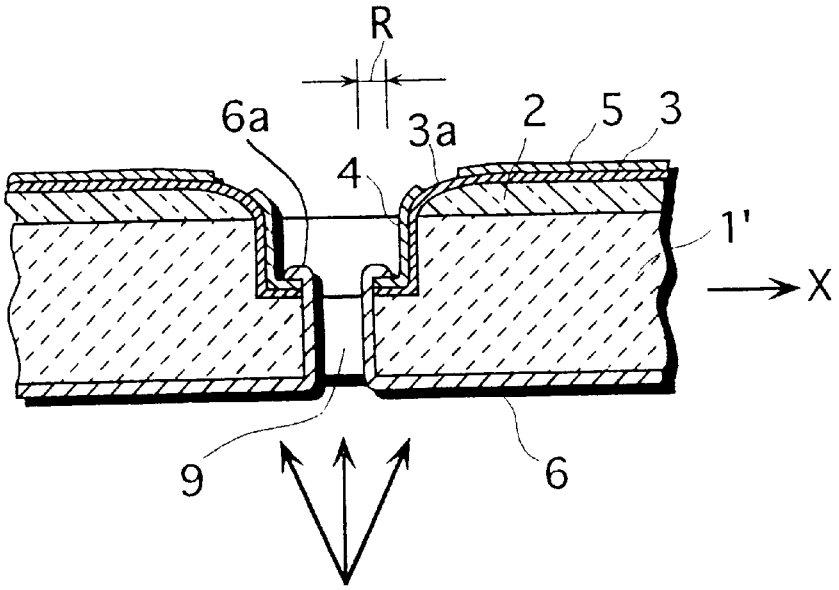

Then, as shown in FIG. 3*h*, while moving the master substrate 1' in the direction of arrow X, conductive metal (aluminum or copper for example) is sputtered from below to form a proper thickness (about 2 μm for example) of auxiliary electrode layer 6 over the reverse surface of the master substrate 1'. Thus, the auxiliary electrode layer 6 will extend into the slit 9 of the master substrate 1' and further turn over onto the step portion 1*d* for electrical conduction with the common electrode pattern 4.

Advantageously, the film thickness of the auxiliary electrode layer 6 in the slit 9 and the turnover of the auxiliary electrode layer 6 into the step portion 1*d* can be controlled by the width of the slit 9.

Finally, though not illustrated, upon forming a protecting layer for the resistor layer 3, the common electrode pattern 4 and the individual electrodes 5, the master substrate 1' is divided along the respective division lines DL1, DL2 (FIG. 3*a*) to provide separate thermal printheads (see FIGS. 1 and 2).

According to the method described above, the formation of the auxiliary electrode 6 can be performed with a non-divided master substrate 1' and there is no need to deal with the plurality of head substrates separately, thereby remarkably improving the production efficiency and reducing the production cost. Further, there is no need to install magagines or tools exclusively used for dealing with the plurality of head substrates, thereby reducing the cost of equipment. Still further, carrying or supporting the master substrate 1' can be performed with the use of the marginal portions of the substrate. Therefore, it is possible to eliminate a secondary damage which might be caused on the individual head substrates due to direct contact with the apparatus in transportation and support.

The condition of electrical conduction between the auxiliary electrode 6 and the common electrode pattern 4 is determined by the turnover R (FIG. 3*h*) of the auxiliary layer 6 for the common electrode pattern 4. As already described, the turnover R of the auxiliary layer 6 is determined by the width W of the slit 9. Therefore, selecting the width W of the slit 9 can control the condition of electrical conduction between the auxiliary layer 6 and the common electrode pattern 4. Some description about this will be given hereinafter by referring to FIG. 4.

Figure 4:
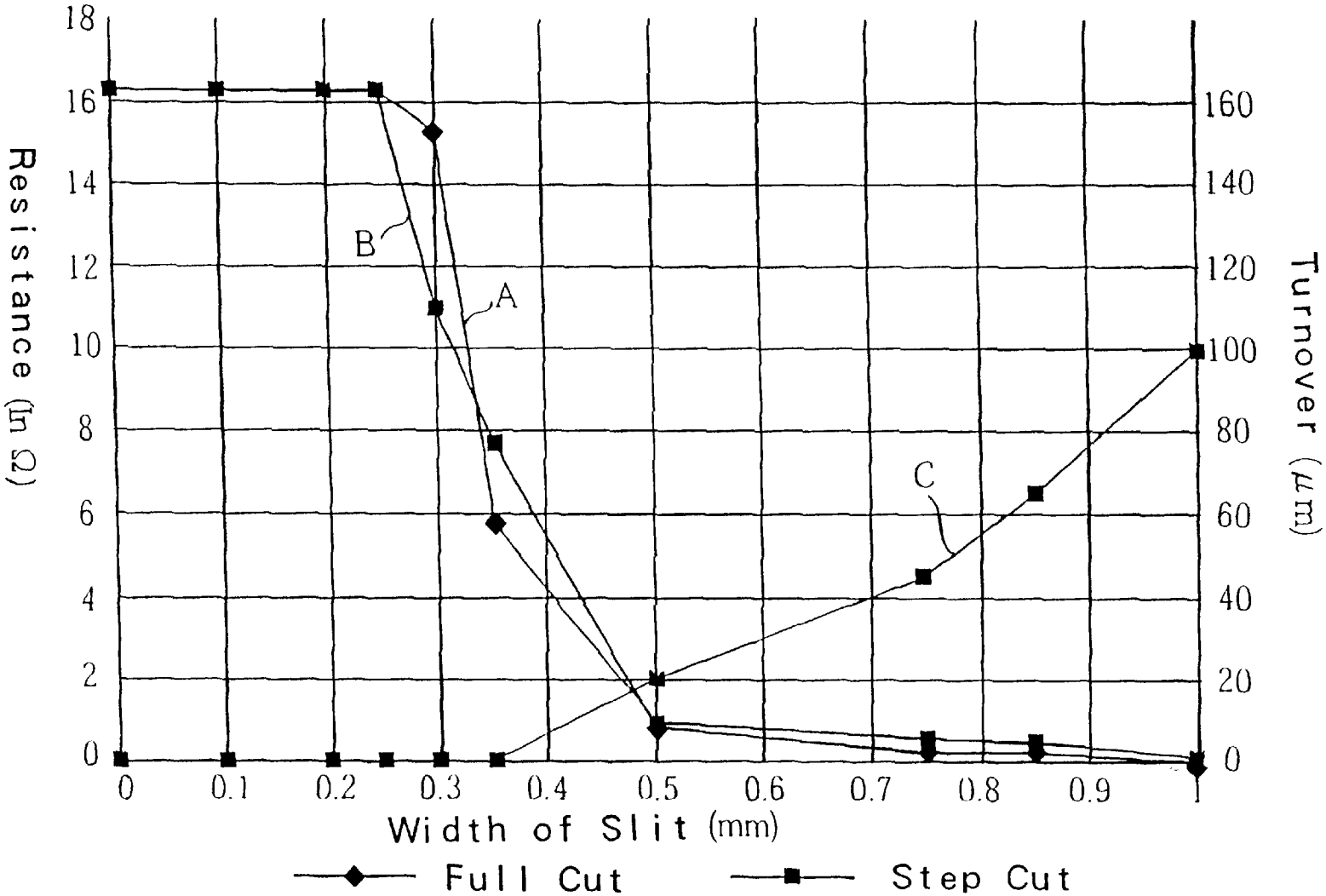
FIG. 4 is a graph showing the resistance and the turnover as a function of the width of a slit used for making an auxiliary electrode layer.
Figure 5:
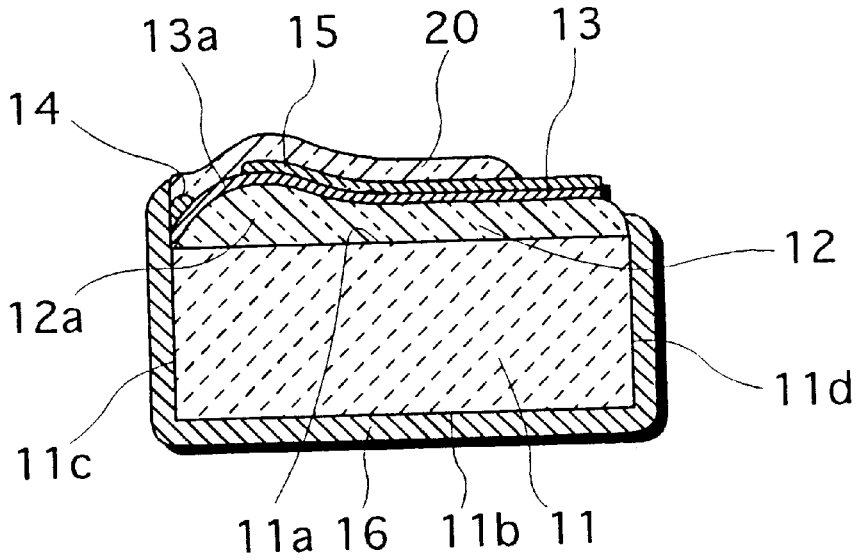
FIG. 5 is a sectional view showing a thermal printhead according to a prior application of the same applicant.
Figure 6:
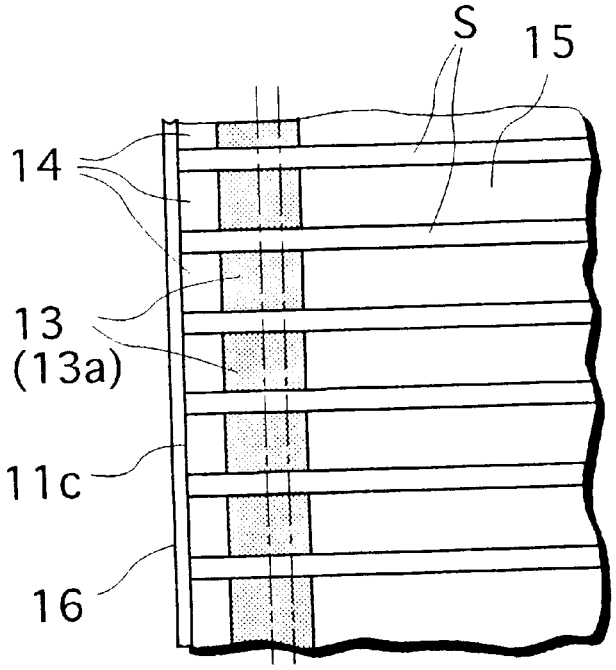
FIG. 6 is a plan view of the thermal printhead of the same prior application.
Figure 7A:
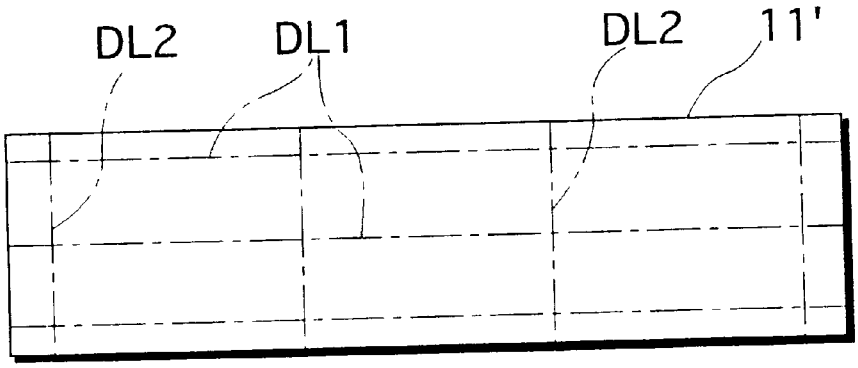
FIGS. 7*a*–7*j* illustrate subsequent steps of making the thermal printhead shown in FIGS. 5 and 6.
Figure 7B:
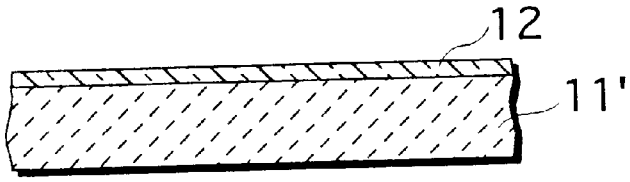
Figure 7C:
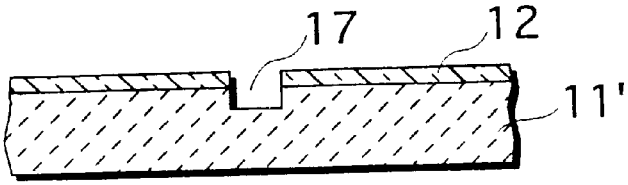
Figure 7D:
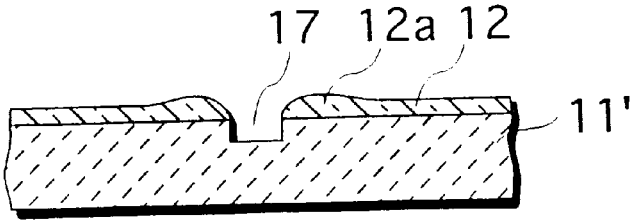
Figure 7E:
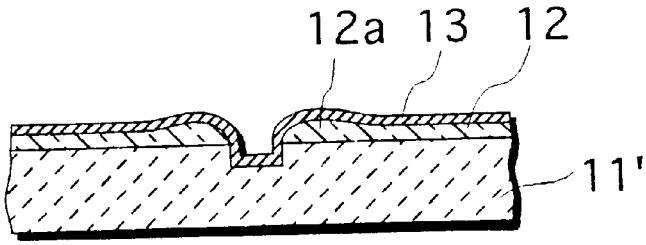
Figure 7F:
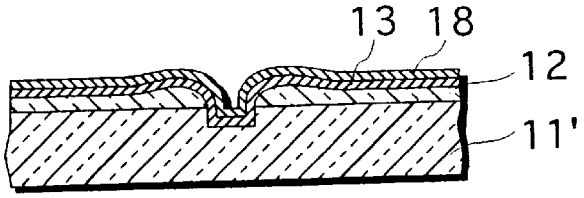
Figure 7G:
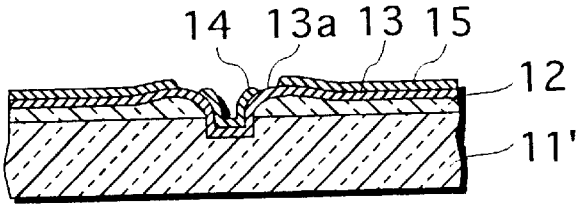
Figure 7H:
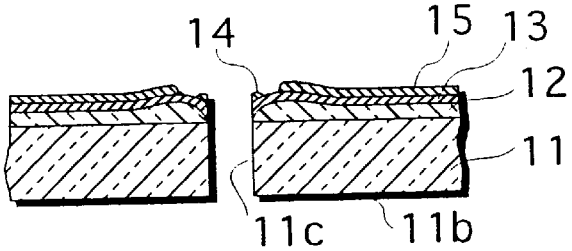
Figure 7I:
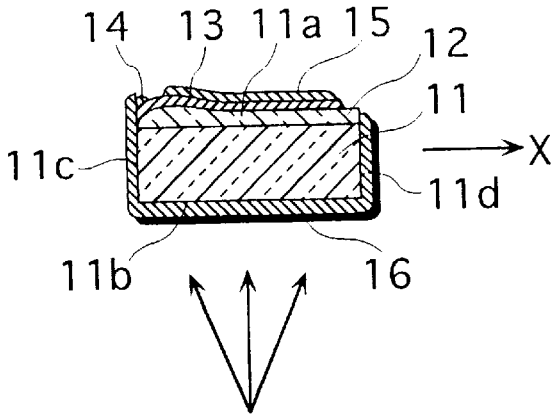
Figure 7J:
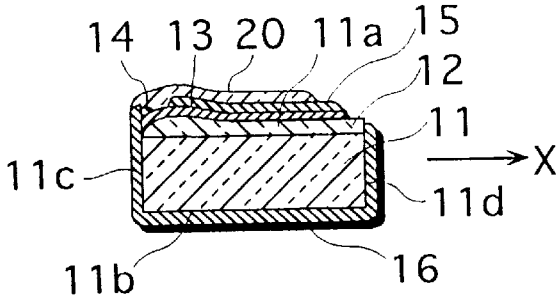

FIG. 4 is a graph showing how the turnover R of the auxiliary electrode 6 changes and also how the electric resistance between auxiliary electrode layer 6 and common electrode pattern 4 changes, depending on the width W of the slit 9. The abscissa of FIG. 4 is assigned to the width W (mm) of the slit. The left-side ordinate in FIG. 4 is assigned to the electrical resistance between the auxiliary electrode layer 6 and the common electrode pattern 4 in natural logarithm (lnΩ), whereas the right-side ordinate is assigned to the turnover R (μm) of the auxiliary electrode layer 6. The resistance between the auxiliary electrode layer 6 and the common electrode pattern 4 was measured between a position on the common electrode pattern 4 spaced by about 0.1–0.2 mm from the surface of the glaze layer 2 formed on the head substrate 1 and a position on the auxiliary electrode layer 6 spaced by 250 mm from the former position.

The curve A in FIG. 4 shows the relation between the slit width W and the resistance measured between the auxiliary electrode layer 6 and the common electrode pattern 4, where a step cut is performed to the slit 9. The curve B shows the relation between the slit width W and the resistance measured between the auxiliary electrode layer 6 and the common electrode pattern 4, where a full cut is performed to the slit 9. The curve C shows the relation between the slit width W and the turnover R.

As can be seen from FIG. 4, where the slit width W is no greater than 0.3 mm, the auxiliary electrode layer 6 can hardly extend onto the common electrode pattern 4 (that is, the turnover R is almost zero, and the auxiliary electrode layer 6 hardly contacts or overlaps the common electrode pattern 4), and the resistance between the auxiliary electrode layer 6 and the common electrode pattern 4 is rendered remarkably high or about 11 MΩ. Alternatively, where the slit width W is within a range of 0.3–0.5 mm (0.3 mm and 0.5 mm not included), the auxiliary electrode layer 6 can gradually extend onto the common electrode pattern 4, whereas the resistance between the auxiliary electrode layer 6 and the common electrode pattern 4 rapidly decreases. Further, where the slit width W is no less than 0.5 mm, the turnover R of the auxiliary electrode layer 6 onto the common electrode pattern 4 is rendered no less than 20 82 m, and the resistance remains in a range of no greater than 22Ω. This follows that the condition of the electrical conduction between the auxiliary electrode layer 6 and the common electrode pattern 4 can be kept within an allowable range by making the slit width W no less than 0.5 mm. Particularly, where the slit width W is no less than 0.8 mm, the turnover R of the auxiliary electrode layer 6 onto the common electrode pattern 4 is no less than 50 μm, thereby realizing a good electrical connection therebetween.

As described above, in the method of the present invention in which the master substrate 1' is formed with a slit 9, the turnover R of the auxiliary electrode layer 6 onto the common electrode pattern 4 is controlled by adjusting the slit width W. Thus, the electrical resistance between the auxiliary electrode layer 6 and the common electrode pattern 4 can be determined to fulfill a desired object.

The preferred embodiment according to the present invention being thus described, the present invention is not limited to the embodiment. For example, the method of making a resistor layer, a common electrode pattern, individual electrodes and an auxiliary electrode layer is not limited to sputtering, but other methods such as CVD method are also applicable. Further, materials and configurations of a head substrate and other constituting elements are not restricted by the embodiment. Still further, the method according to the present invention is applicable to production of a thin film-type thermal printhead as well as a thick film-type thermal printhead.

I claim:

1. A method of making an auxiliary electrode layer for a common electrode pattern in a thermal printhead, the method compromising the steps of:

preparing a master substrate which has an obverse surface provided with a common electrode pattern and corresponds to a plurality of head substrates;

forming at least one slit in the master substrate, the slit extending along the common electrode pattern; and sputtering a metal material toward a reverse surface of the master substrate, to form an auxiliary electrode layer on the reverse surface of the master substrate the metal material also entering into the slit so that the auxiliary electrode layer extends via the slit into electrical connection with the common electrode pattern.

2. The auxiliary electrode layer method according to claim 1, wherein the slit has a width of no less than 0.5 mm.

3. The auxiliary electrode layer method according to claim 2, wherein the slit has a width of no less than 0.8 mm.

4. The auxiliary electrode layer method according to claim 1, wherein the master substrate has at least one groove extending along the common electrode pattern, the common electrode pattern extending into the groove, a step portion being provided by forming the slit in the groove so that the slit is smaller in width than the groove, the auxiliary electrode layer being arranged to extend onto the step portion into electrical connection to the common electrode pattern.

* * * * *